US005984359A

United States Patent [19]

Faiks

[11] Patent Number: 5,984,359

[45] Date of Patent: Nov. 16, 1999

[54] SPORT POLE

[75] Inventor: Frederick S. Faiks, Greenville, Mich.

[73] Assignees: Carl V. Forslund, E. Grand Rapids; James A. Mitchell, Grand Rapids, both of Mich.

[21] Appl. No.: 09/024,328

[22] Filed: Feb. 17, 1998

Related U.S. Application Data

[60] Provisional application No. 60/043,142, Apr. 11, 1997.

[51] Int. Cl.[6] ..... A63C 11/22; A45B 9/02

[52] U.S. Cl. ..... 280/819; 280/821; 135/86

[58] Field of Search ..... 280/813, 819, 280/820, 821, 822, 823; 135/65, 68, 69, 72, 82, 86, 911; 248/620; 43/18.1

[56] References Cited

U.S. PATENT DOCUMENTS

| | | | |
|---|---|---|---|
| 384,470 | 6/1888 | Pluche | 135/68 |
| 1,843,714 | 5/1932 | Fuller | 43/18.1 |
| 4,244,602 | 1/1981 | Allsop et al. | 280/821 |
| 5,236,222 | 8/1993 | Fletcher | 280/809 |

FOREIGN PATENT DOCUMENTS 2596998 10/1987 France .

*Primary Examiner*—J. J. Swann
*Assistant Examiner*—Christopher Bottorff
*Attorney, Agent, or Firm*—Price, Heneveld, Cooper, DeWitt & Litton

[57] ABSTRACT

The specification discloses a sports pole including at least two flexible rods, the first of which is held in compression and the second of which is held in tension by the spatial arrangement of the two rods relative to one another and relative to the handle. The tension rod is slidably connected to the handle at one end and fixedly connected to the compression rod at the other end. When the user plants the pole, the movement of the tension rod within the handle allows the compression rod to deflect further, thereby acting as an energy absorbing member. As the user advances through the pole stroke, the energy stored in the pole during planting and pushing is released as the compression rod returns to its original position. This yields a forward force applied to assist the user in forward motion.

13 Claims, 3 Drawing Sheets

SPORT POLE

This claims the benefit of U.S. Provisional Application No. 60/043,142, filed Apr. 11, 1997.

BACKGROUND OF THE INVENTION

The present invention relates to ski poles, though it is applicable to a wide variety of sports and accordingly, is referred to herein as a "sport pole. " Ski poles are used for downhill skiing, cross-country skiing and more recently, in-line skating. Ski poles typically comprise a rod of limited flexibility having a handle on one end and a point on the other end. The pointed end is usually equipped with a basket or some type of stop a couple of inches up from the point. Most of the innovation in ski poles has been related to the selection of materials used in the rod. One manufacturer has apparently placed a cushioning spring in the handle in order to cushion the impact of planting the pole on the user's wrists.

SUMMARY OF THE INVENTION

The present invention comprises a sport pole comprised of at least two flexible rods, the first of which is held in compression and the second of which is held in tension by the spatial arrangement of the two rods relative to one another and relative to the handle. The compression rod is mounted at one end in the handle. The tension rod is slidably connected to the handle at one end and fixedly connected to the compression rod at the other end. The length of the tension rod is such that the compression rod is placed in compression bending and thereby deflected and "preloaded" with a compression-bending force. When the user plants the pole, the movement of the tension rod within the handle allows the compression rod to deflect further, thereby acting as an energy absorbing member. As the user advances through his or her pole stroke, the energy stored in the pole during planting and pushing is released as the compression rod returns to its original position. This yields a forward force applied to assist the user in forward motion.

Such a sports pole has exceptional applications in both cross-country and downhill skiing, in-line skating, aerobic walking, mall walking and the like. These and other objects, advantages and features of the invention will be more fully understood and appreciated by reference to the written specification and appended drawings.

DESCRIPTION OF THE PREFERRED EMBODIMENT

Figure 1:
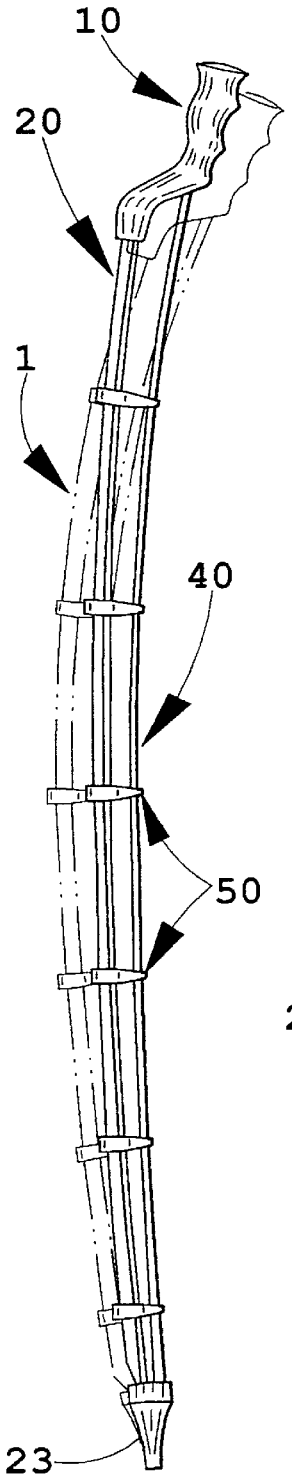
FIG. 1 comprises a side view of the sport pole of the present invention shown in its "at rest" position, and being shown in phantom in its flexed condition.
Figure 2:
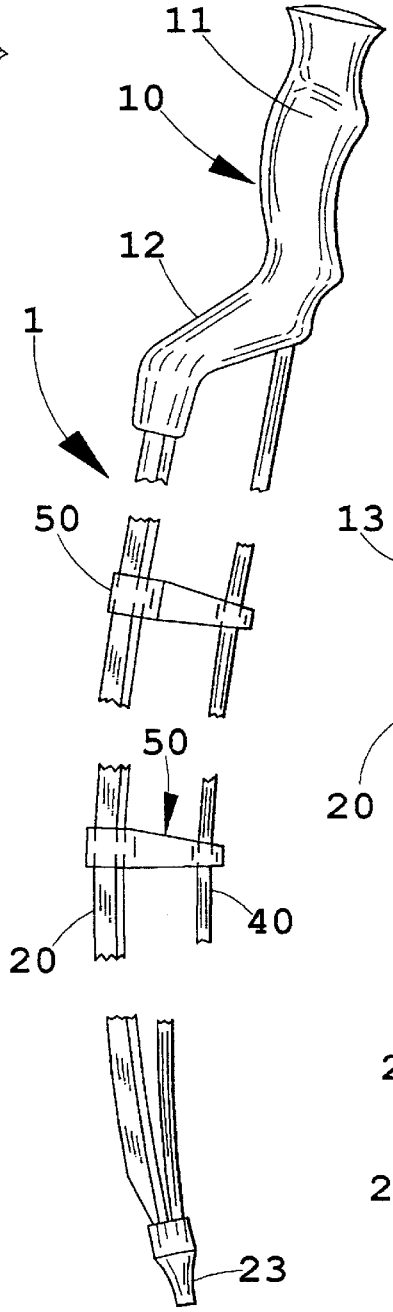
FIG. 2 is a fragmentary enlarged side elevational view of the pole.

In the preferred embodiment, sport pole 1 includes a flexible compression rod 20 extending from handle 10 to a remote tip 23 (FIGS. 1 and 2). A tension rod 40 slidably mounted within the slide chamber 30 of handle 10 also extends from handle 10 and is joined to fixed flexible compression rod 20 at tip 23 (id and FIG. 3). Alignment trusses 50 are fixedly joined to fixed flexible compression rod 20 and slidably positioned on tension rod 40 for the purpose of holding fixed compression rod 20 and tension rod 40 in alignment with one another.

Figure 3:
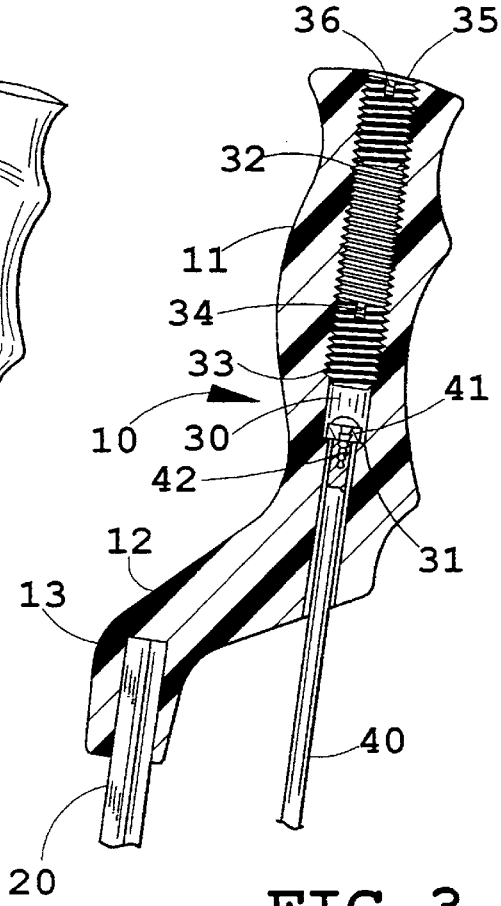
FIG. 3 is a fragmentary enlarged view of the handle end of the pole, with the handle shown in cross section.

Handle 10 is preferably made of a strong, polymeric material. It includes a grip 11 and a lateral bridge 12 which extends between grip 11 and an offset end 13 (FIGS. 2 and 3). The purpose of lateral bridge 12 of handle 10 is to laterally offset the securement point and longitudinal axis of compression rod 20 from slide chamber 30 in which tension rod 40 is slidably received. Flexible compression rod 20 is received in a mating aperture within offset end 13 of handle 10. An adhesive can be used to help secure compression rod 20 in place within offset end 13.

Compression rod 20 is made of a somewhat stiff yet flexible material. A glass fiber reinforced polymeric material has been found acceptable. Other composite materials, some metals and other polymeric materials may also be operable. The material must be sufficiently flexible to allow the compression rod to store energy through deflection bending, but sufficiently stiff that a significant return force is applied when the compression rod returns to its original condition.

Preferably, compression rod 20 incorporates a cross section shape to yield a higher stiffness to weight ratio such as the "T-shaped" in cross section (FIG. 7), comprising a blade 21 and a backbone or spine 22. Compression rod 20 extends from its position in lateral offset end 13 to its remote end which terminates in a tip 23 which is fixedly secured to the remote end of compression rod 20. Tip 23 is made of a material and design most suited to its intended use. Thus if the pole will primarily be used on hard surfaces such as sidewalks, tip 23 will be of a blunt configuration and be made of a high friction material. On a ski pole, tip 23 will be more pointed.

Slide chamber 30 comprises a longitudinal bore within grip 11 of handle 10. It includes an upper portion of a larger diameter and a lower portion of a narrower diameter so as to create an annular shoulder defining a first stop 31 within slide chamber 30 (FIG. 3). The upper portion of slide chamber 30 is threaded at threads 32 to receive a threaded, adjustable second stop 33. Adjustable stop 33 includes a slotted top 34 so that a screwdriver or like tool can be inserted into slide chamber 30, engaged in slot 34 and twisted to adjust the position of stop 33 within slide chamber 30. In this way, the distance between first stop 31 and second stop 33 can be adjusted. The top of grip 11 is then closed off with a cap 35 which also threads into the top of slide chamber 30 and includes a slot 36 for receiving a screwdriver or like tool.

Tension rod 40 can be made of the same material as compression rod 20, or one of the alternative materials discussed can be used. Tension rod can be of various shapes to increase the stiffness to weight ratio. Tension rod 40 must be somewhat flexible, yet preferably is somewhat stiff so as to contribute to the energy storing and rebound characteristics of pole 10. Tension rod 40 is fixedly secured at one end within pole tip 23, and is slidably mounted at the other end within slide chamber 30. A retainer 41 is secured to the top of rod 40 by means of a screw 42 or the like. Retainer 41 is trapped between first and second stops 31 and 33 in slide chamber 30.

The length of tension rod 40 relative to compression rod 20 is such that it maintains compression rod 20 in compression, and thereby slightly deflected. This preloads compression rod 20 with a force which is designed to be:

1. sufficiently low that compression rod 20 can be deflected further upon the application of a longitudinally downward force on said pole, and yet,
2. sufficiently great that when the downward force on said pole is released, the reaction force exerted by the return of compression rod 20 its "at rest" position will assist the user in his or her forward arm motion, and to some extent provide forward propulsion to the user.

The precise quantities desired for both the preloading force and the rebound force to be obtained can be determined by one of ordinary skill in the art without undue experimentation and can be predetermined at the point of manufacture. Different users may want different forces in order to obtain poles having different characteristics for use in different sports, or to accommodate different user body weight. These forces may also be made adjustable in the pole, as will be seen in alternative embodiments discussed below.

Figure 7:
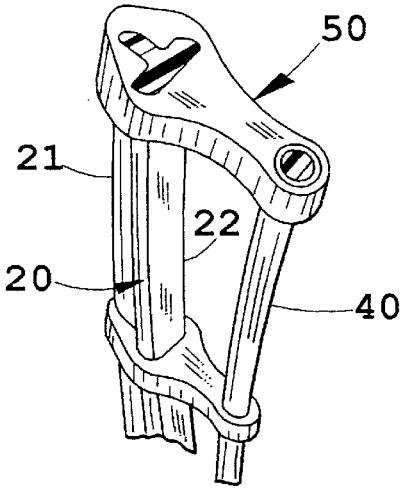
FIG. 7 is a fragmentary perspective view of the alignment trusses of the pole.

Preferably, compression rod 20 and tension rod 40 are held in alignment with respect to one another by alignment trusses 50 (FIGS. 1, 2 and 7). Alignment truss 50 includes two openings, one having a generally "T-shaped" section for receiving compression rod 20, and the other being circular in cross section to receive tension rod 40. Alignment trusses 50 are fixedly secured to compression rod 20 by adhesive or the like. However, tension rod 40 is slidably mounted within alignment trusses 50. Alignment trusses 50 are of varying lengths as one proceeds from the top to the bottom of pole 10, in order to accommodate varying stresses between compression rod 20 and tension rod 40 as one proceeds along the length of pole 10, distributing the stresses uniformally. Alignment trusses 50 are made of a polymeric material, glass fiber reinforced material, metal or composite material. It is important that the material be sufficiently strong to resist breakage during normal use and frictional wear by reason of the sliding movement of tension rod 40 relative to trusses 50.

Figure 4:
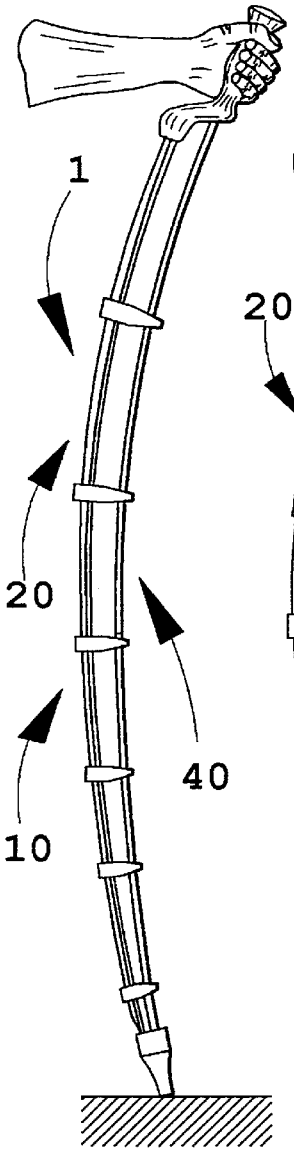
FIG. 4 shows a side elevational view of the pole being held in the manner in which it would be normally held by a user.
Figure 5:
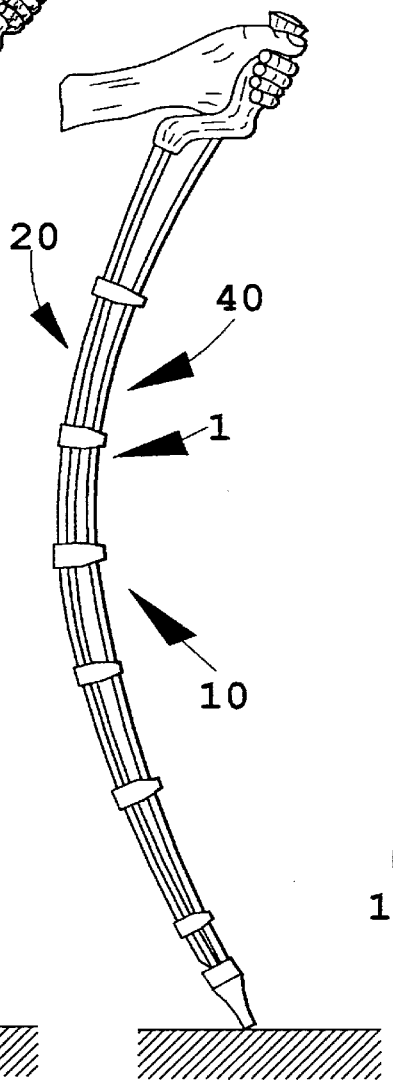
FIG. 5 is the same view as FIG. 4, with the user having applied a downward or planting force to the pole.

In use, a user plants pole 10 and applies a downward force, thereby compressing pole 10. As the downward compression force is applied to pole 10, compression rod 20 is deflected further and tension rod 40 slides up in slide chamber 30 (compare FIGS. 4 and 5). Tension rod retainer 41 slides off of first stop 31 and proceeds upwardly in slide chamber 30 until it engages second stop 33, which prevents further sliding motion of tension rod 40, and hence prevents any further deflection of compression rod 20 and tension rod 40. At the end of the pole plant the tension member bottoms out in the slide chamber and produces a highly rigid truss arrangement which acts both as a stabilizing element to assist in the user's control and a means by which the user is propelled forward. At this time the geometry of the pole represents a "truss" and becomes stiff, preventing or reducing further deflection. This allows the user to propel forward and provides stability to the user. Thus the pole is flexible when flexibility is desirable, i.e., the beginning of the plant and stroke, and rigid when rigidity and stability are desired, i.e., the mid to end portion of the stroke when maximum rearward force on the pole is being exerted.

Figure 6:
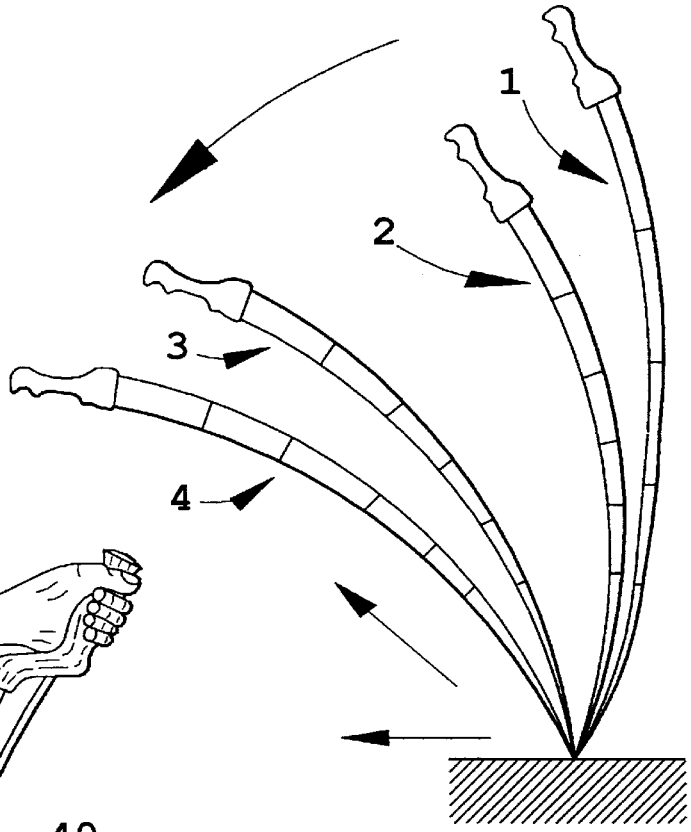
FIG. 6 is a view of the pole in four different positions, from the beginning of a plant to the point at which the pole is "released" at the end of the user's forward motion.

As the user then propels himself or herself past the point of the plant, the pole tends to rotate in a counterclockwise direction as viewed in FIG. 6. Pole 10 is in compression in positions 1 and 2 as shown in FIG. 6, but the compression force is released as the user moves forward relative to the point of the plant, and the pole begins to return to its original condition at approximately position 3. The energy stored in the deflected compression rod 20 and tension rod 40 is then released, thereby giving a forward motion to the user, which is applied to the user's arm. At position 4, rod 10 is returned to its "at rest" condition with tension rod retainer 41 engaging first stop 31 in slide chamber 30.

It can be seen that the amount of energy stored during the compression and release cycle of application of pole 10 can be adjusted by adjusting the "stroke" of slide chamber 30. This is done by adjusting second stop 33 either upwardly or downwardly within the threaded upper portion 32 of slide chamber 30.

Alternative Embodiments

Figure 8:
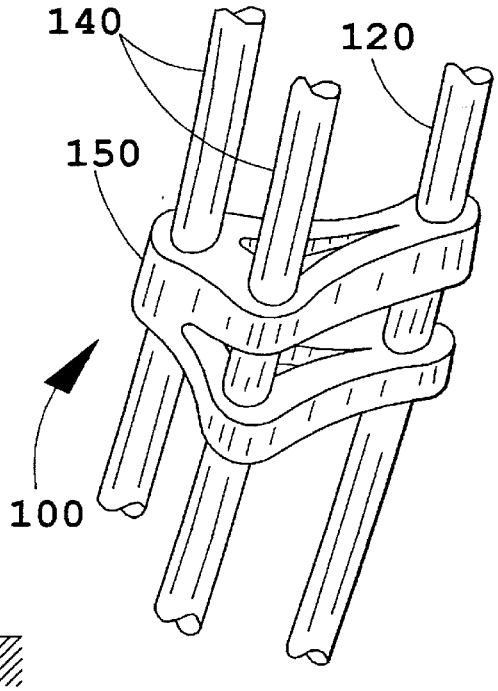
FIG. 8 is a perspective fragmentary view of an alternative embodiment pole having one compression rod and two tension rods.

FIG. 8 discloses a fragmentary perspective view of an alternative embodiment pole 100 which includes a single compression rod 120 of generally circular cross section and two tension rods 140. Alignment truss 150 is triangularly configured so as to accommodate all three flexible rods 120 and 140. In all other particulars, the construction of alternative embodiment pole 100 is comparable to that of pole 1.

Figure 9:
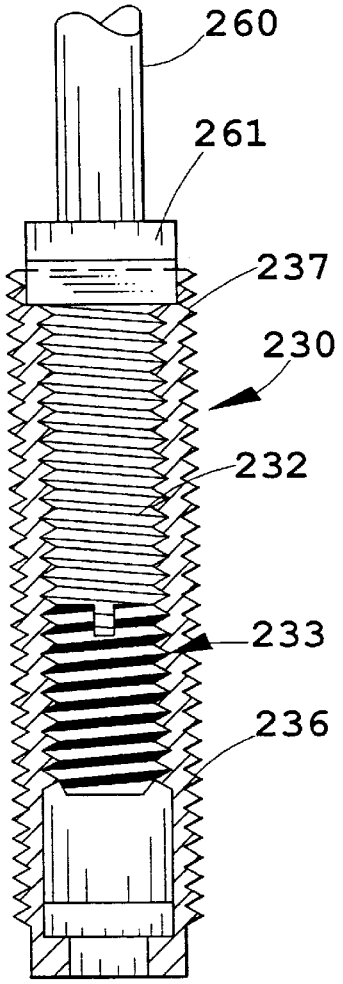
FIG. 9 is a cross-sectional view of an alternative embodiment slide chamber being engaged by an adjustment tool.
Figure 10:
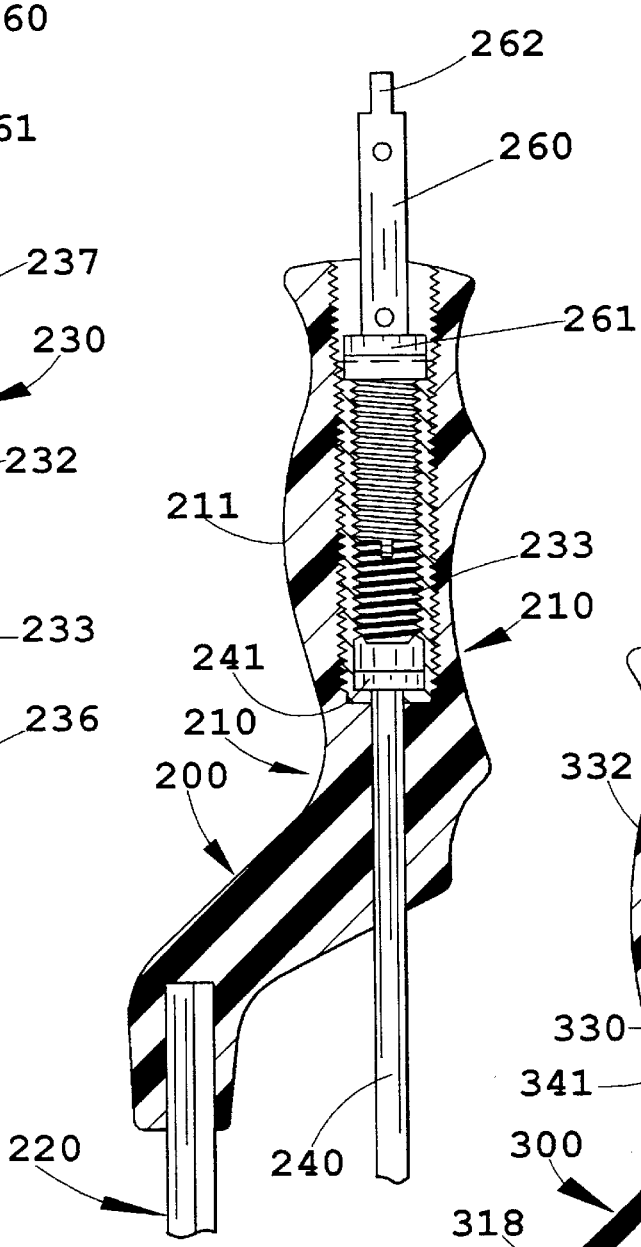
FIG. 10 is a partial cross sectional view of the end of a handle with the adjustable slide chamber positioned in it.

In the alternative embodiment pole 200 of FIGS. 9 and 10, a slide chamber 230 is provided which is threaded both internally at 232 so as to receive an adjustable second stop 233, but also externally at 236. Slide chamber 230 itself includes an upper slot 237 which receives the blade 261 of an adjustment tool 260. The adjustment tool 260 includes an alternative, smaller blade 262 at its end opposite from blade 261, so that tool 260 can be inverted, inserted into the interior of slide chamber 230 and engaged with the slotted top in adjustable stop 233. Slide chamber 230 is threaded into an internally threaded bore in grip 211 of handle 210. The preload force applied to compression rod 220 of alternative embodiment pole 200 can be adjusted by adjusting the relative position of threaded slide chamber 230 within the threaded interior of handle grip 211. The stroke of pole 200 can be adjusted by adjusting the relative position of adjustable stop 233 within the threaded interior of adjustable slide chamber 230.

Figure 11:
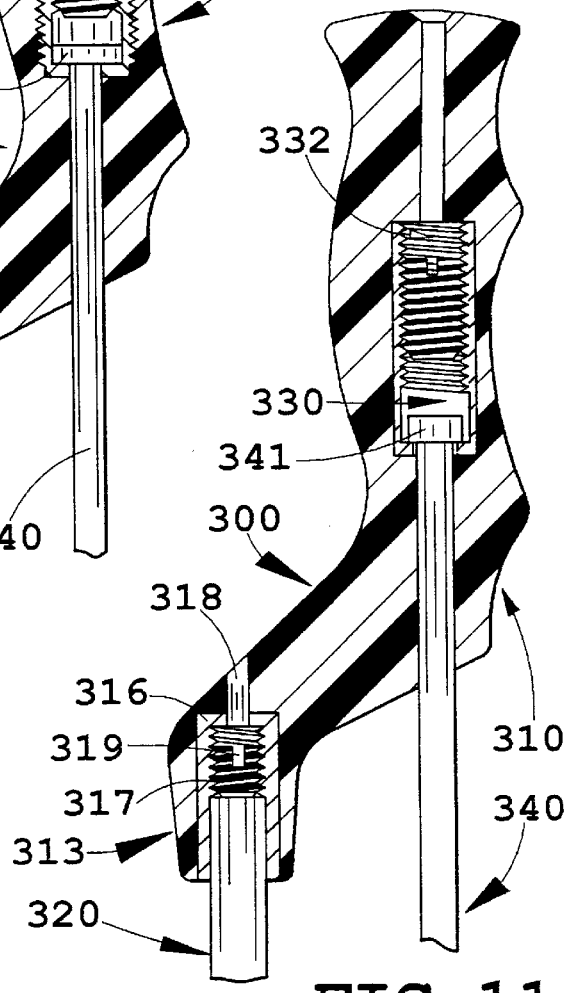
FIG. 11 is a cross sectional view of yet another alternative embodiment handle.

FIG. 11 discloses the handle end of yet another alternative embodiment pole 300 in which preload adjustment is accomplished by making the point at which compression rod 320 is mounted in offset end 313 adjustable. A mounting chamber 316 is provided within offset end 313 for receiving the end of compression rod 320. Receiving chamber 316 has a threaded interior which receives a threaded adjustment stop 317. By placing the blade of a screwdriver or the like through access opening 318 at the top of receiving chamber 316 and into engagement with the slot 319 in the top of threaded stop 317, one can thread stop 317 downwardly and thereby increase the compressive deflection force on compression rod 320. It may not be necessary to provide a lower stop, although one may optionally be provided, in view of the fact that compression rod 320 is maintained in compression by the force exerted by tension rod 340. By threading stop 317 upwardly, one decreases the preloaded compressive force on compression rod 320.

To the extent that the various preferred embodiment poles can be adjusted, i.e., the preload force or the "stroke," such adjustment can be preset at the factory, adjusted by the dealer and/or adjusted by the user. Indeed even if not adjustable, the poles could be variously manufactured to suit the strengths and weights of different users, e.g., light, medium or heavy. The dealer could have test models for the user to try. The dealer could then adjust the adjustable models to match the test model found most suited to the customer.

Of course, it is understood that the above are merely preferred embodiments of the invention, and that various changes and alterations can be made without departing from the spirit and broader aspects of the invention as set forth in the appended claims.

What is claimed is:

1. A sports pole comprising:

a handle;

a first flexible rod, comprising a compression rod, mounted at one end in said handle and extending longitudinally from said handle to a remote point spaced from said handle;

said handle including a slide chamber spaced laterally from the axis of said longitudinally extending compression rod, said slide chamber having an axial length defined by first and second axially spaced stops, said first stop being spaced toward said remote point on said compression rod and said second stop being spaced away from said remote point;

a second rod comprising a tension rod fixedly secured to said first rod at said remote point and extending from said remote point into said slide chamber;

said tension rod including a tension rod retainer within said slide chamber which is movable between said first and second stops of said slide chamber;

said tension rod having a length relative to said compression rod such that said compression rod is placed in compression and thereby slightly deflected to preload said compression rod with a preloaded force, said preloaded force being sufficiently low to allow further deflection of said compression rod upon application of a downward force on said pole by a user and resultant sliding of said tension rod relative to said slide chamber, and said preloaded force being sufficiently great that when said downward force on said pole is released and said pole releases stored energy, it provides a reaction force which will assist the user in his or her forward arm motion, and to some extent provide forward propulsion to the user by reason of said compression rod and said tension rod returning to their original at rest positions.

2. The sports pole of claim 1 which additionally includes a plurality of alignment trusses extending between said compression rod and said tension rod to hold said compression rod and said tension rod in alignment with one another and distribute stresses during use of said pole.

3. The sports pole of claim 2 in which said first and second stops in said slide chamber are adjustable relative to one another to thereby vary the distance which said retainer on said tension rod can move within said slide chamber, thereby facilitating adjustment of the amount of energy which can be stored in said pole upon the application of a downward, compressive force.

4. The sports pole of claim 3 in which the longitudinally axial positions of the point at which said compression rod is mounted in said handle and the position of said slide chamber in said handle can be adjusted relative to one another to thereby adjust the amount of compressive force which is preloaded into said sports pole.

5. The sports pole of claim 4 in which the position of said slide chamber within said handle is adjustable to thereby effect adjustment of said preloaded compressive force on said pole.

6. The sports pole of claim 4 in which the end of said compression rod is mounted in a receiving chamber in said handle, said receiving chamber including a stop which is engaged by the end of said compression rod; said stop being adjustable within said receiving chamber whereby the compressive force preloaded into said compression rod can be varied.

7. The sports pole of claim 1 in which said first and second stops in said slide chamber are adjustable relative to one another to thereby vary the distance which said retainer on said tension rod can move within said slide chamber, thereby facilitating adjustment of the amount of energy which can be stored in said pole upon the application of a downward, compressive force.

8. The sports pole of claim 7 in which the longitudinally axial positions of the point at which said compression rod is mounted in said handle and the position of said slide chamber in said handle can be adjusted relative to one another to thereby adjust the amount of compressive force which is preloaded into said sports pole.

9. The sports pole of claim 8 in which the position of said slide chamber within said handle is adjustable to thereby effect adjustment of said preloaded compressive force on said pole.

10. The sports pole of claim 8 in which the end of said compression rod is mounted in a receiving chamber in said handle, said receiving chamber including a stop which is engaged by the end of said compression rod; said stop being adjustable within said receiving chamber whereby the compressive force preloaded into said compression rod can be varied.

11. The sports pole of claim 1 in which the longitudinally axial positions of the point at which said compression rod is mounted in said handle and the position of said slide chamber in said handle can be adjusted relative to one another to thereby adjust the amount of compressive force which is preloaded into said sports pole.

12. The sports pole of claim 11 in which the position of said slide chamber within said handle is adjustable to thereby effect adjustment of said preloaded compressive force on said pole.

13. The sports pole of claim 11 in which the end of said compression rod is mounted in a receiving chamber in said handle, said receiving chamber including a stop which is engaged by the end of said compression rod; said stop being adjustable within said receiving chamber whereby the compressive force preloaded into said compression rod can be varied.

* * * * *